United States Patent [19]

Horvath et al.

[11] Patent Number: 4,651,900

[45] Date of Patent: Mar. 24, 1987

[54] DUAL COMPARTMENT SERVING POT

[76] Inventors: Ronald F. Horvath; Barbara Horvath, both of 5835 Margery Dr., #201, Racine, Wis. 53406

[21] Appl. No.: 796,177

[22] Filed: Nov. 8, 1985

[51] Int. Cl.[4] ..... A47G 19/12

[52] U.S. Cl. ..... 222/144.5; 215/6; 220/23.4; 222/129; 222/466

[58] Field of Search ..... 222/129, 143, 142.1, 222/142.2, 142.6–142.9, 144.5, 465 R, 465 A, 466, 467; 206/501; 215/6, 10, 13 A, 13 R; 220/23.4, 23.83, 23.86, 20, 22, 23.6, 23.2, 94 B; 99/448

[56] References Cited

U.S. PATENT DOCUMENTS

| | | | |
|---|---|---|---|
| 1,184,549 | 5/1916 | McClung | 222/142.6 X |
| 1,312,203 | 8/1919 | Picard | 222/129 |
| 1,314,379 | 8/1919 | Travis | 222/142.1 X |
| 2,470,432 | 5/1949 | Cusick | 220/94 B X |
| 2,661,678 | 12/1953 | Freeman | 222/142.2 |
| 2,681,745 | 6/1954 | Sung et al. | 222/144.5 |
| 2,743,846 | 5/1956 | Walker | 222/129 |
| 4,094,449 | 6/1978 | Schlegel et al. | 222/465 A X |
| 4,301,942 | 11/1981 | Kupperman et al. | 220/22 X |

FOREIGN PATENT DOCUMENTS

| | | | |
|---|---|---|---|
| 14169 | of 1909 | United Kingdom | 220/94 B |
| 150293 | 9/1919 | United Kingdom | 220/23.2 |

*Primary Examiner*—Joseph J. Rolla
*Assistant Examiner*—Kevin P. Shaver
*Attorney, Agent, or Firm*—Andrus, Sceales, Starke & Sawall

[57] ABSTRACT

A dual compartment serving pot includes a pair of pot halves having substantially flat inner walls with the walls abutting each other when said halves are joined to form a single serving pot having a pair of compartments. A locking device is provided for releasably maintaining the halves in engagement with each other and a lid member connected to one of the halves and movable between first and second positions for selectively closing the opening to one of the compartments and opening the other compartment.

3 Claims, 6 Drawing Figures

DUAL COMPARTMENT SERVING POT

U.S. PRIOR ART OF INTEREST

| U.S. Pat. No. | Inventor | Issue Date |
|---|---|---|
| 1,577,781 | Adams | 03-23-26 |
| 2,661,678 | Freeman | 12-08-53 |
| 3,327,881 | Maier | 06-27-67 |
| 3,337,073 | Angelo | 08-22-67 |
| 3,705,661 | Davis | 12-12-72 |
| 3,998,351 | Smith et al | 12-21-76 |
| 4,279,349 | Aigner | 07-21-81 |

BACKGROUND AND SUMMARY OF THE INVENTION

This invention relates to a serving pot and more specifically to a serving pot having dual compartments.

As the concern over the undesirable side effects caused by the ingestion of caffeine increased it became the custom of most restaurants, coffee shops, etc. to offer both "regular" and "decaffeinated" coffee. Typically, when both types of coffee are offered, the establishment brews and serves each type of coffee in a separate serving pot. Customarily, the "decaffeinated" coffee is served in a pot having an orange top while the "regular" coffee is served in a pot having a brown top. The use of two separate pots causes the waitress or other server to make a number of trips between the brewing area and the serving area or in the alternative to carry a pot in each hand.

While the devices shown in the prior art patents listed above deal with the broad concept of compartmentalized serving pots, they have a number of drawbacks. For instance, the device shown in the U.S. Pat. No. 1,577,781 patent only has one pouring spout, while a number of the other devices either do not have a removable top or are not easily separated. Also, a number of the devices are not provided with a pivoting cap for selectively opening one of the openings in a compartmentalized pot.

In accordance with one aspect of the invention, a compartmentalized serving pot is provided with a pair of pot halves having substantially flat inner walls that abut each other when the halves are joined so as to form a single serving pot with the walls cooperating to define a divider in the pot so as to define a pair of compartments in the pot.

In accordance with another aspect of the invention, the serving pot is provided with locking means which releasably maintains the halves in engagement with each other.

In accordance with yet another aspect of the invention, a lid member is connected to one of the halves and is movable between first and second positions to selectively close one of the openings and open the other during serving.

The present invention thus provides a compartmentalized serving pot which can be separated so that each halve may be filled independently of the other and then the halves may be joined to form a single serving container having a lid member that selectively opens or closes one or the other of the pot halves.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
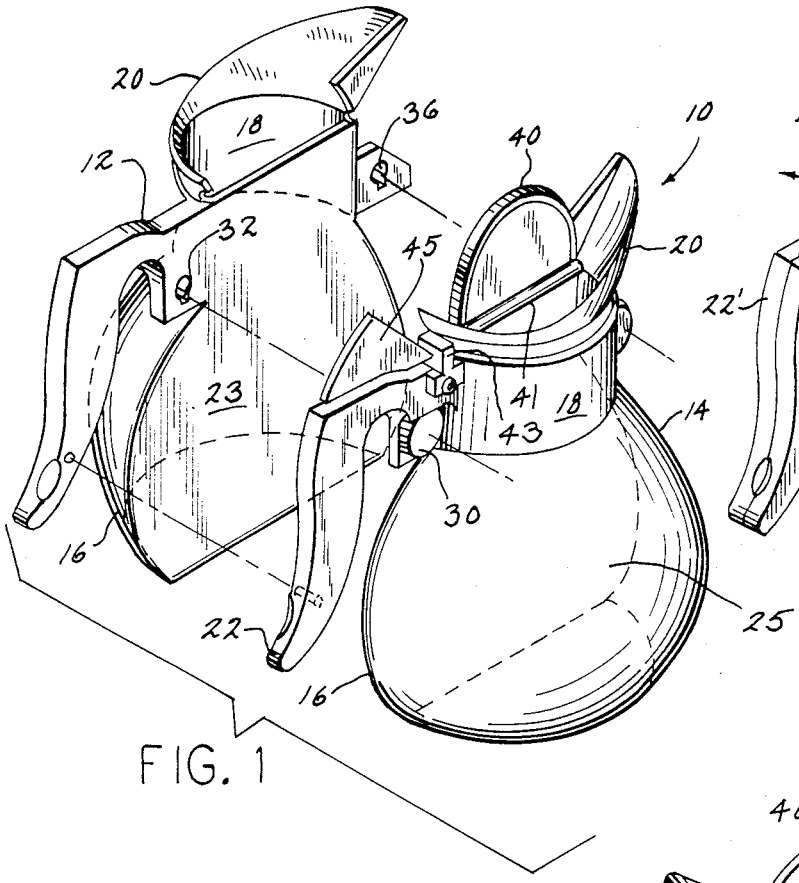
FIG. 1 is a perspective view of a serving pot constructed according to the invention with the pot halves in a separated condition.

As shown in FIG. 1, a compartmentalized serving pot 10 includes a first halve 12 and a mating second halve 14.

Each halve is provided with a lower container portion 16, a neck portion 18 extending upwardly from container portion 16 and a spout portion 20 connected to neck portion 18. Each pot halve is also provided with a handle portion 22 that extends outwardly and then downwardly from neck portion 18. Pot halves 12 and 14 are also provided with side walls 23 and 25 so as to form dual compartments when the pot halves 12 and 14 are joined to form a single pot.

Figure 3:
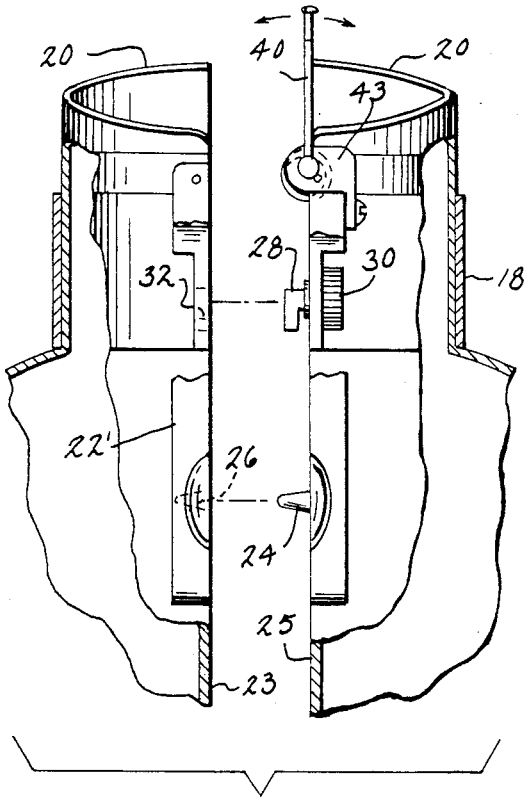
FIG. 3 is an end view with parts broken away of the handle area of the serving pot.
Figure 4:
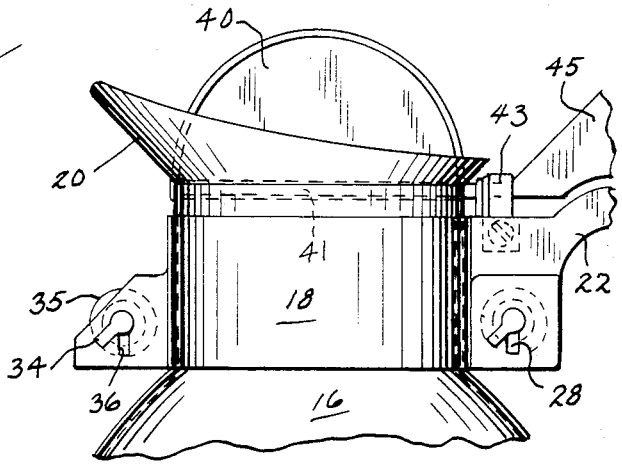
FIG. 4 is a side view of the top portion of the serving pot.

As concerns handle portion 22, it can be seen in FIG. 3 that one of handle portions 22 is provided with a projection 24 while the other handle portion 22 is provided with a hole 26 for accepting projection 24 when handle portions 22 are aligned and the pot halves are joined. One of handle portions 22 is also provided with a locking key 28 rotatable by knob 30 and engageable with keyhole 32 disposed within the other handle portion 22.

Another locking key 34 rotatable by knob 35 and having a corresponding keyhole 36 is located at the front of pot 10, opposite handle portions 22 on neck portion 18.

Figure 2:
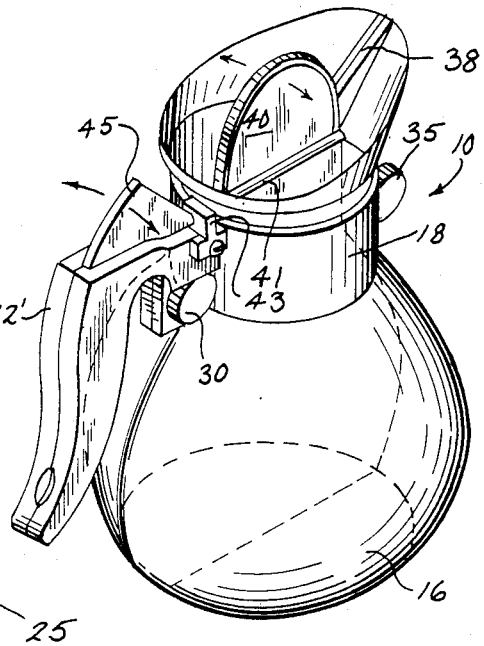
FIG. 2 is a perspective view of the serving pot of FIG. 1 with the pot halves joined.

When the pot halves are joined, as is shown in FIG. 2, handle portions 22 mate to form a single handle 22' and locking keys 28 and 34 are rotated in corresponding keyholes 32 and 36 so as to secure pot halves 12 and 14 in a joined relationship. Also, as seen in FIG. 2 spout portions 20 will mate to form a continuous spout having a divider 38.

Pot halve 14 is provided with a pivoting lid 40 which may be selectively positioned to close the opening at the top of neck portion 18 in either pot halve 12 or pot halve 14. Lid 40 is attached to pivoting rod 41 which is retained in one of the pot halves by a lip (not shown) and which extends rewardly from the pot, through spring housing 43 and terminates in selection tab 45. A spring (not shown) is disposed within spring housing 43 and biases lid 40 to an upright position, as shown in FIG. 2. Pressure applied by the server's thumb or finger to tab 45 overcomes the biasing force of the spring and allows the server to selectively cover one of the pot halves.

Figure 6:
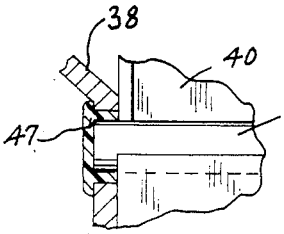
FIG. 6 is a side cross-sectional view of the forward end of the pivoting rod holding the pivoting lid.

As seen in FIG. 6, the forward end of the rod 41 is provided with a seal 47 that engages rod 41 and maintains rod 41 in position when the pot halves are separated.

Figure 5:
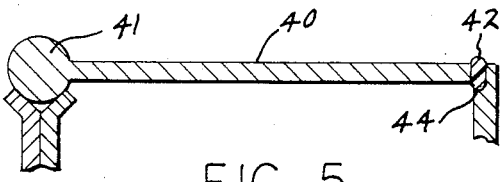
FIG. 5 is a cross-sectional view of the pivoting lid of the serving pot.

As seen in FIG. 5, lid 40 is provided with a seal 42 that mates with a notch 44 formed in the edge of neck portion 18. This seal and notch arrangement prevents liquid from the capped halve from flowing out into the spout during pouring of liquid from the uncovered halve of the pot.

In use, pot halves 12 and 14 are separated and placed under separate coffee dispensers. Typically, one halve will be placed under a brewing machine that dispenses "regular" coffee and the other halve will be placed under a separate brewing machine that dispenses "decaffeinated" coffee. Once the pots have been filled, they are aligned so that projection 24 mates with hole 26 and locking keys 28 and 34 align with keyholes 32 and 36. The halves are then joined and the locking keys are rotated to secure them in a joined fashion.

The server of the coffee is now able to carry a single pot that contains both "regular" and "decaffeinated" coffee. In order to differentiate between the two types of coffee it is possible to color one of neck portions 18 and spout portions 20 a color that corresponds with the type of coffee contained in that halve. When one type of coffee is selected the server need only pivot lid 40 so as to cover the non-selected coffee and then pour a selected coffee from the uncovered halve into the cup. Divider portion 38 on spout 20 and seal 42 in combination with notch 44 will prevent the co-mingling of the two types of coffee.

Various modes for carrying out the invention are contemplated as being within the scope of the following claims particularly pointing out and distinctly claiming the subject matter which is regarded as the invention.

We claim:

1. A dual compartment serving pot comprising:

a pair of pot halves having substantially flat inner walls with said walls abutting each other when said halves are joined to form a single serving pot with said walls cooperating to define a divider in said pot so as to define a pair of compartments in said pot and each of said halves having an opening in its upper portion, first and second handle halves with said first handle half connected to one of said pot halves and said second handle half connected to the other of said pot halves, said handle halves abutting each other when said pot halves are joined and forming a single handle for the serving pot, locking means for releasably maintaining said halves in engagement with each other, divider means for maintaining said openings distinct and separate when said halves are joined and a lid member pivotally connected to one of said pot halves and movable between first and second positions to selectively close one of said openings and open the other of said openings.

2. The serving pot defined in claim 1 wherein said locking means is disposed within said first and second handle halves.

3. A dual compartment serving pot comprising:

first and second pot halves having substantially flat inner walls abutting each other when said halves are joined to form a single serving pot with said walls cooperating to define a pair of compartments in said pot, each of said pot halves having a lower body portion, an upper neck portion connected to, communicating with and extending upwardly from said lower body portion and having an opening at its upper end, a spout portion connected to and extending outwardly from the upper opening of said neck portion, a handle portion connected to said neck portion, said spout portions and handle portions abutting each other when said first and second pot halves are joined and forming a single spout and a single handle for the serving pot, said inner walls extending across substantially the entire height of said body and neck portions, locking means for releasably maintaining said first and second pot halves in engagement with each other, divider means connected to at least one of said spout portions to define separate and distinct pouring halves in said single spout when said first and second pot halves are joined, and a lid member pivotally connected to the upper edge of one of said walls so that said lid member may be pivoted to selectively close one of said openings in one of said neck portions and open the other of said openings.

* * * * *